US007638445B2

(12) United States Patent
Patrick

(10) Patent No.: US 7,638,445 B2
(45) Date of Patent: Dec. 29, 2009

(54) MEMBRANE ENCAPSULATED FIBER AND METHOD FOR PRODUCING SAME

(76) Inventor: Gilbert Patrick, 635 Dixon School Rd., Kings, Mountain, NC (US) 28086

( * ) Notice: Subject to any disclaimer, the term of this patent is extended or adjusted under 35 U.S.C. 154(b) by 111 days.

(21) Appl. No.: 11/733,912

(22) Filed: Apr. 11, 2007

(65) Prior Publication Data

US 2008/0096017 A1 Apr. 24, 2008

Related U.S. Application Data

(60) Provisional application No. 60/862,673, filed on Oct. 24, 2006.

(51) Int. Cl.

| | |
|---|---|
| ***A01G 9/24*** | (2006.01) |
| ***A01G 25/02*** | (2006.01) |
| ***D02G 3/22*** | (2006.01) |
| ***D02G 3/38*** | (2006.01) |
| ***D03D 15/00*** | (2006.01) |
| *D01H 4/00* | (2006.01) |

(52) U.S. Cl. ..... 442/190; 442/189; 442/334; 442/353; 428/375; 428/377; 405/36; 405/43; 405/45; 405/52; 405/302.4; 405/302.6; 405/302.7; 47/79; 47/81; 57/210; 57/224; 57/235

(58) Field of Classification Search ..... 428/372, 428/375, 378, 380, 383, 392, 394, 395
See application file for complete search history.

(56) References Cited

U.S. PATENT DOCUMENTS

| | | | | |
|---|---|---|---|---|
| 3,172,234 | A * | 3/1965 | Eavis | 47/59 R |
| 4,056,103 | A * | 11/1977 | Kaczmarzyk et al. | 604/375 |
| 5,421,123 | A * | 6/1995 | Sakate et al. | 47/56 |
| 5,930,949 | A | 8/1999 | Tsujimoto et al. | |
| 5,974,732 | A * | 11/1999 | Saito | 47/56 |
| 6,330,385 | B1 * | 12/2001 | Sheu | 385/109 |
| 6,743,212 | B1 * | 6/2004 | Cole et al. | 604/385.17 |
| 7,009,020 | B2 | 3/2006 | Doane et al. | |
| 7,052,775 | B2 | 5/2006 | Dohrn et al. | |
| 2002/0002226 | A1 | 1/2002 | Barnett | |
| 2003/0097104 | A1 * | 5/2003 | Gilbert | 604/370 |
| 2005/0254899 | A1 * | 11/2005 | Tyler | 405/15 |
| 2007/0087162 | A1 * | 4/2007 | Mandawewala | 428/97 |

FOREIGN PATENT DOCUMENTS

WO WO 2004090083 A1 * 10/2004

* cited by examiner

*Primary Examiner*—Jennifer A Chriss
(74) *Attorney, Agent, or Firm*—Womble Carlyle Sandridge & Rice, PLLC

(57) ABSTRACT

This invention generally relates to the production of a composite yarn or non-woven strand wherein a core of super absorbent fibers or polymers (SAP's) having a swell factor of approximately 25% and greater are encapsulated by a non-woven membrane of defined porosity. The membrane is then sealed in a fashion to generally deter or prevent the SAP material from migrating out of the core as water is freely absorbed and desorbed from the composite yarn structure. The strands of yarns or strips of non-woven material are subsequently constructed into an open or unorientated fabric formation. When used as a subterranean fabric, structure or material, the resultant fabric structure retains moisture while permitting normal root growth and allowing excess water to pass through and beneath the fabric while facilitating movement of water from lower levels to the surface.

9 Claims, No Drawings

MEMBRANE ENCAPSULATED FIBER AND METHOD FOR PRODUCING SAME

CROSS REFERENCE TO RELATED APPLICATIONS

The present patent application is a formalization of previously filed, co-pending U.S. provisional patent application Ser. No. 60/862,673, filed Oct. 24, 2006, by the inventors named in the present application. This patent application claims the benefit of the filing date of the cited provisional patent application according to the statutes and rules governing provisional patent applications, particularly USC § 119 (e)(1) and 37 CFR § 1.78(a)(4) and (a)(5). The specification and drawings of the provisional patent application are specifically incorporated herein by reference.

FIELD OF THE INVENTION

This invention generally relates to the production of a composite yarn or non-woven strand and in particular to a composite yarn having a core of super absorbent fibers or polymers (SAP's) encapsulated by a nonwoven membrane of a defined porosity.

BACKGROUND OF THE INVENTION

Fresh water supplies are becoming increasingly scarce as the world's population continues to increase. Many countries with arid climates and sporadic rainfall experience continual crop failures resulting in chronic food shortages. Most municipalities in developed countries also restrict water usage for lawns as their fresh water supply diminishes.

Systems and materials now have been developed to improve moisture retention and stabilization in soil by adding organic conditioners to help perpetuate plant growth with lower water usage. Such conditioners/stabilizers have been used in many forms, mostly using some type of cellulosic material such as dried plants from the Plantago family. The application of such conditioners/stabilizers to soil, however, generally requires extensive soil preparation, including tilling the soil, adding the stabilizer, and then tilling the stabilizer into the soil. Being organic, the level of effectiveness of the conditioners/stabilizers further has a diminishing timeline as the elements of nature break down the molecular structures of the cellulosic fibers. An example of this approach is disclosed in Doane, U.S. Pat. No. 7,009,020, which teaches methods of producing starch-graft copolymer granules to mix with fertilizer. Doane further describes the coating of seeds and plant roots with such absorbent granules. Tsujimoto, U.S. Pat. No. 5,930,949, describes methods of hydrating seeds with SAP's prior to germination, however, the SAP particles generally are separated from the seeds before they are planted.

Alternatively, surface water retention nets as described in Matsumoto U.S. Pat. No. 5,601,907 disclose the use of coating applied to a net with a water absorbing resin for the purpose of retaining moisture on the surface of the net. This netting material appears to work well for the purpose of seeding hillsides or rocky areas where vegetation is needed and the soil cannot be properly prepared before planting. However the capability of the net to absorb and retain large amounts of moisture is limited and exposure to the heat of the sun allows a large percentage of moisture to evaporate without aiding in the growth of the vegetation.

Another material, described in Hubbs U.S. Pat. No. 5,746,546, details the use of water absorbent, swellable adhesive particles mixed with textile fibers and aggregate particles. The adhesive particles bind the fibers with the aggregate, providing a surface that has a quick recovery after wet conditions. This method is advantageous in golf course sand traps or athletic fields where it is desirable to have a resilient surface without using large rock or gravel base materials. However, it does not describe a method of retaining moisture to perpetuate vegetation and decrease water usage.

Still further, Kido, U.S. Pat. No. 6,248,444, and Dohrn, U.S. Pat. No. 7,052,775, both describe methods of producing cellulosic fibers, while Saotome U.S. Pat. No. 5,026,596, describes a method of heat-bonding a SAP material to a textile substrate, for forming disposable diapers.

U.S. Pat. No. 6,178,691 teaches the production of a capillary carpet irrigation system. This product, marketed as "Aquamat™," consists of four layers: a water impermeable base membrane of polyethylene, a water permeable microperforated dark colored top membrane, and two polyester needle punched mats of differing densities. This structure, however, requires a herbicide based root-blocking mechanism to be placed between the plants and the mat, and is not intended for permanent, subterranean installation.

Cargill, U.S. Pat. Publication No. 2005/0118383, discloses a structure having encapsulated SAP granules between multiple layers of textile fabrics. The structure retains large amounts of water and is said to offer benefits due to evaporative cooling. In addition to personal cooling devices, use of the fabric material for fire deterrent blankets also is disclosed.

It therefore can be seen that an economical subterranean geo-textile fabric capable of retaining large amounts of water and releasing it as the soil begins to dry, therefore aiding in the growth of vegetation and decreasing the amount of water required would be desirable. Such a fabric also needs to be durable, environmentally friendly, and have porosity that will not deter plant root growth or the normal transmission of moisture.

SUMMARY OF THE INVENTION

Briefly described, in one example embodiment, a super absorbent polymer ("SAP") is extruded into filaments and cut into staple fibers. A composite core strand containing the SAP fibers is then prepared by conventional cotton system spinning methods that could include but are not limited to carded sliver, drawn sliver, roving, rotor spinning, ring spinning, air jet spinning, or friction spinning methods. The composite core strand with SAP fibers is then encapsulated by wrapping a membrane of a defined desired porosity and sealing the yarn strand by methods including thermal bonding, adhesive bonding, sonic welding, needle punching or sewing.

An alternative embodiment utilizes a Dref friction spinning system and method to produce the composite textile yarn. A spun core yarn containing the SAP fibers, such as wrapped in a sheath about a core of textile fibers, is fed into the Dref spinning elements in parallel with a membrane substrate that has been slit into a ribbon. When the membrane contacts the spinning drums it is caused to be wrapped/curled at least temporarily around the core yarn. While this temporary state is maintained by the friction of spinning, detached staple fibers are fed at about a ninety degree angle with respect to the membrane-wrapped core yarn structure from the carding unit so as to wrap tangentially around the membrane-wrapped core yarn structure, thus permanently affixing the membrane in a three-dimensional orientation around the core.

Various objects, features and advantages of the present invention will become apparent to those skilled in the art upon review of the following detailed description, when taken in conjunction with the accompanying drawings.

DETAILED DESCRIPTION OF THE INVENTION

In one preferred embodiment of the present invention, a super absorbent polymer or fiber ("SAP") generally having a swell factor of about 25% or greater is formed into a composite core yarn strand. The SAP selected preferably can be a modified hydrophilic polyacrylate, but also could include any other SAP that could be extruded as a filament such as starch grafted copolymers or cross-linked carbon methylcellulose, and also could include SAPs having a greater or lesser swell factor, depending on the particular application or use desired for the fabric structure formed using the composite SAP core yarn of the present invention. The SAP polymer material is extruded into filaments and cut into staple fibers that can range in length from about 0.05" to about 2.0", although other size fibers also can be formed. This fiber is characterized by very low tensile strength and elongation. The composite core yarn strand containing the SAP fiber is formed by blending the SAP fibers with textile fibers in proportions ranging from about 20% to about 80% SAP and about 80% to about 20% conventional fibers that could include, but are not limited to, cotton, rayon, flax, jute, knaf, ramie, polyester, polyolefin, polyamide, acrylic, polyethylene, PLA, and PTT fibers and/or blends thereof.

The composite core yarn strand generally is prepared by conventional cotton system spinning methods that could include, but are not limited to, carded sliver, drawn sliver, roving, rotor spinning, ring spinning, air jet spinning, or friction spinning. The composite core yarn strand is then encapsulated by a membrane generally composed of cotton, rayon, flax, jute, knaf, ramie, polyester, polyolefin, polyamide, acrylic, polyethylene, PLA, PTT, and/or blends thereof, or other similar encapsulating material. The membrane will be selected as having a defined porosity or pores with pore opening sizes within a range of typically between about 5 microns to about 220 microns, although greater or letter porosities also can be used, and generally is sealed about the core strand by one of various sealing/encapsulating methods including thermal bonding, adhesive bonding, sonic welding, needle punching, or sewing.

In an alternative embodiment of the present invention, a composite core yarn containing a hydrophilic polyacrylate or other suitable SAP fiber is formed by intimately blending the SAP fiber in a ratio ranging from approximately 20% to approximately 80% with conventional textile fibers, said conventional fibers generally including, but are not limited to, cotton, rayon, flax, jute, wool, polyester, polyolefin, polyamide, acrylic, fibers and/or blends thereof by a spinning process using the ring, rotor, air jet, or friction methods. Strands of fibers are prepared for the sheath formed about the core and generally can include, but are not limited to, cotton, rayon, flax, jute, wool polyester, polyolefin, polyamide, acrylic, fibers and/or blends thereof. These sheath fibers are fed into the back of a Dref spinning machine with the core fibers for spinning together to form a composite spun yarn. For example, the present invention can utilize a Dref 3000, Dref 2, 2000 or Dref 3 spinning machine that is capable of producing the desired composite yarns depending upon the yarn size and the fiber lengths utilized. Several strands of the composite yarns are fed together to compose a total weight of about 220-400 grains per yard.

As these composite yarns with SAP fibers enter the spinning zone of the Dref spinning machine, a carding drum covered with a saw-toothed wire reopens and individualizes the fibers and propels them into the nip or crotch between two perforated drums. The perforated drums are rotated in the same direction at a predetermined rate ranging from 1,500 RPM to 4,000 RPM with an adjustable negative vacuum in the range from about 70 to about 110 millibars being applied at the crotch between the perforated drums where the fibers are received from the carding drum, although greater or lesser pressures also can be used. A membrane ribbon, that generally will comprise from about 5% to about 30% or more of the weight of the entire structure, generally formed from cotton, rayon, flax, jute, knaf, ramie, polyester, polyolefin, polyamide, acrylics and/or blends thereof or other, similar encapsulating materials, and the core yarn are fed in parallel at one end of the rotating drums and are pulled through the spinning zone of the spinning machine by an outlet roller at the rear of the spinning zone.

As the membrane/core yarn structure passes through the spinning zone of the spinning machine, the composite core yarn with SAP fiber sheath is pre-positioned so that the membrane substantially completely encapsulates the core structure with the individualized fibers being rotated or spun around the membrane, completely covering it to a desired percentage and substantially keeping it from unraveling. The number of strands of the card sliver, the weight per unit length, and the denier of the core yarn can be varied to determine the percentage of membrane, core, and sheath fibers in the overall composite fiber structure.

This process results in a composite yarn structure where the membrane is held in place by the mechanical tension of the outer sheath of staple fibers. It has been demonstrated that this generally will effectively seal the membrane, locking in most of the SAP fibers over repeated absorptive/desorptive cycles. However, because the SAP fibers still could eventually breach the mechanical membrane seal, it is envisioned that an ultrasonic or thermal sealing head also can be mounted at the exit of the Dref spinning zone to thermally seal the membrane by sonic friction. This sealing method has been demonstrated to produce a substantially total and permanent containment of the SAP fiber subject only to the permeability characteristics of the membrane material. It also has been envisioned that the utilization of one or more sewing heads or an adhesive application also can be used to bond the membrane to the outer sheath, so as to seal about the core yarn of SAP fibers, either in conjunction with or in place of the ultrasonic, infra-red, or thermal sealing mechanism.

The membrane material utilized in the present invention generally will be selected based upon its pores having a desired porosity or pore opening sizes in the range from about 5 to about 200 microns (although other porosities also can be used, depending upon the application for the encapsulated yarns) that permits the transpiration of water freely without allowing the hydrated gel particles of the core to escape. The membrane material also generally is very thin and sufficiently pliable to allow the Dref spinning elements to form it around the core without tangling or unduly tearing the membrane material. The membrane material also can include a thermoplastic material to permit sealing via sonic or heat welding. Examples of nine polyolefin thermally bonded filtration substrates were acquired having a porosity or pore opening sizes ranging from about 5.0 microns to about 220 microns. Experiments dictated that pretreatment with a liquid synthetic surfactant to negate surface tension present that would inhibit transpiration of water.

The resultant composite yarn structure with encapsulated SAP fibers formed according to the principles of the present invention is now ready to be assembled into an open configuration fabric for use in sub-soil water retention application. This can be done by conventional weaving or knitting techniques or by various nonwoven processes such as heat bonding, needle punching or melt extrusion processes, provided that the assembly process leaves an open grid-work formed in a repeating geometric pattern having defined open spaces or gaps of between ⅛" to about 6" between the yarn strands, although greater or lesser size spaces also can be used, and capable of allowing excess water and plant roots to pass by the fabric. Another configuration could incorporate the present invention into a three dimensional geotextile fabric with large diameter fibers in the denier ranges generally between about 9 and about 300 denier in a random, omni-directional arrangement, or on an open grid-work configuration having open spaces of approximately 1/16"-⅛" up to about 6" or more therebetween to create a fabric more resilience to soil pressure. This generally will help the membrane-coated yarn strands not to become compacted over time and retain a large working area. However, care has to be taken that soil or sand has to be used to fill in the voids of the fabric to prevent root fungi from developing.

The preferred and alternative embodiments of the present invention further are disclosed herein as containing non-biodegradable materials and generally are intended to remain functional in their subterranean environment long term. However, it is anticipated and should be understood that certain applications could require the structures of the present invention to be fabricated of one hundred percent biodegradable textile materials that would eventually decompose under the ground. The life span and rate of such decomposition could be predetermined by specifying the content of cellulose-based textile fibers utilized in forming the SAP fiber blended yarn structure.

Trials/Testing

A sample of a Dref-spun composite core yarn made from staple fibers according to the present invention was produced from a modified hydrophilic polyacrylate polymer blended with conventional 3 denier polyester staple fibers. A polyolefin membrane having a porosity of about 120 micron was sonically welded around the composite core yarn utilizing an off-line sonic bonding machine. This yarn then was tested for water absorption and retention in comparison to testing with a similar size strand cut from a conventional Aquamat™ (100% polyester) product.

| | Percent of Original Weight Absorbed | Percent of Original Weight Retained after 8 hours |
|---|---|---|
| Presented Invention | 900% | 532% |
| Aquamat ™ | 706% | 190% |

It can be observed that although the Aquamat™ (100% polyester) takes on a relatively large amount of water initially, a significant amount of the trapped water is not retained over time. This is because the polyester fibers are actually hydrophobic and the water is only temporarily captured within the interstices of the structure. With the present invention, however, the SAP composite core yarn swells and retains a large majority of the water absorbed even after significant time lapse.

In a second series of tests, boxes of sand and topsoil were prepared with composite core yarns of the present invention prepared in accordance with the alternative embodiment discussed above (a Dref spun yarn with a polyacrylate SAP core, 120 micron polyolefin membrane, and staple polyester outer sheath) laid in a matrix form below the surface. Control test boxes were also prepared that: 1) did not contain any matter other than equal amounts of sand and dirt; and 2) had a matrix of 100% cotton yarn of approximately the same weight and configuration as the Dref spun composite SAP yarn.

Test Apparatus for Sand Box Testing

1. Boxes were fabricated from lexan plastic panels measuring 24×24×12 inches.
2. Play sand was placed in boxes and leveled to a uniform depth of 3 inches.
3. The sand was allowed to dry until the moisture content was less than 5%.
4. Two, 150 watt heat lamps were suspended over each box at a height of 12 inches above the surface.

Test Method For Sand Box Testing

1. Form a one inch square perpendicular grid of test yarns at a depth of one inch below the surface.
2. Uniformly sprinkle 32.2 ounces of water over the surface of the sand. This is equivalent to about 0.10 inch of rainfall.
3. Burn heat lamps approximately 12 hours per work day.
4. Maintain surface soil temperature of 98-102 degrees F.
5. Using a Mesdan Moisture Monitor probe, measure the soil moisture content at a depth of one inch, making sure the probe is not in contact with the test yarn. Perform this measurement at the end of the work day before the heat lamps are turned off.

Results from Testing in Sand Box

| | Day | | | | | | | |
|---|---|---|---|---|---|---|---|---|
| | 1 | 2 | 3 | 4 | 5 | 6 | 7 | 8 |
| TEST (Dref Spun composite SAP Yarn) | 100% | 75% | 75% | 65% | 55% | 45% | 20% | 35% |
| CONTROL (No Yarn) | 100% | 45% | 55% | 40% | 28% | 22% | 17% | 32% |

Test Apparatus for Topsoil Test

1. Back molded plastic trays measuring 18×32×12 inches were acquired.
2. Play sand was placed in boxes and leveled to a uniform depth of 2 inches.
3. Organic topsoil was sifted three times to homogenize, placed in trays on top of sand, and leveled to a uniform depth of 2 inches.
4. The topsoil was allowed to dry until the moisture content was less than 5%.
5. Two, 150 watt heat lamps were suspended over each tray at a height of 12 inches above the surface.

Test Method for Topsoil Test

1. Form a one inch square perpendicular grid of test yarns at a depth of one inch below the surface.
2. Uniformly sprinkle 53.57 ounces of water over the surface of the topsoil. This is equivalent to about 0.25 inch of rainfall
3. Burn heat lamps approximately 12 hours per work day.
4. Maintain surface soil temperature of 98°-102° F.
5. Using a Mesdan Moisture Monitor probe, measure the soil moisture content at a depth of one inch, making sure the probe is not in contact with the test yarn. Perform this measurement at the end of the work day before the heat lamps are turned off.

Results Comparing Water Retention in Topsoil Containing Invention Versus Plain Topsoil

| | Day | | | | | | | | |
|---|---|---|---|---|---|---|---|---|---|
| | 1 | 2 | 3 | 4 | 5 | 6 | 7 | 8 | 9 |
| TEST (Dref Spun composite SAP Yarn) | 100% | 100% | 75% | 98% | 25% | 35% | 35% | 36% | 25% |
| CONTROL (No Yarn) | 95% | 60% | 60% | 50% | 11% | 8% | 9% | 1% | 2% |

Results Comparing Water Retention in Topsoil Containing Presented Invention Versus Topsoil Containing Absorbent Cotton Yarn

| | Day | | | | | |
|---|---|---|---|---|---|---|
| | 1 | 2 | 3 | 4 | 5 | 6 |
| TEST (Dref Spun composite SAP Yarn) | 60% | 50% | 35% | 30% | 24% | 25% |
| CONTROL (Cotton Yarn) | 25% | 25% | 7% | 17% | 8% | 12% |

Conclusions from Testing

It can be readily observed from the presented testing that the invention, represented as the test sample, caused the sand and the topsoil to retain significantly more water than the control samples containing no yarn. Likewise, the topsoil containing the composite SAP yarn retained significantly more water than the soil containing a conventional cotton absorbent yarn. It also will be understood that composite SAP yarn of the present invention further can be woven, knitted or otherwise formed into a fabric structure having an open configuration with defined spaces or voids, or can be formed with a strand arranged in a substantially random configuration. When used as a subterranean fabric structure or material, the resultant fabric structure substantially retains moisture while permitting normal root growth and allowing excess and/or non-absorbed water to pass through and beneath the fabric and facilitating movement of collected water from lower levels of plant root structure toward the surface of the soil.

It will be further understood by those skilled in the art that while the present invention has been described above with reference to preferred embodiments, numerous variations, modifications, and additions can be made thereto without departing from the spirit and scope of the present invention as set forth in the following claims.

The invention claimed is:

1. A fabric comprising a plurality of composite yarns, each composite yarn comprising a spun core of super absorbent fibers having a swell factor, sufficient to enable retention of absorbed water over a desired period of time and encased in a non-woven membrane of a defined porosity to enable transpiration of non-absorbed water therethrough, and with the membrane sealed about the core to substantially contain the super absorbent fibers from within the core; wherein the fabric substantially retains moisture while permitting root growth and allowing excess water to pass through the fabric, facilitating movement of collected water from lower levels of a plant root structure toward a soil surface.

2. The fabric of claim 1, comprising an open configuration including open spaces between the composite yarns in a range of about ⅛"to about 6 "and formed in a repeating geometric pattern.

3. The fabric of claim 1, wherein placement of the composite yarns within the fabric is random and omnidirectional with a series of open spaces formed therebetween.

4. The fabric of claim 1, comprising a three-dimensional geotextile fabric structure adapted to absorb and retain large quantities of water after a significant lapse of time.

5. The fabric of claim 1, wherein the super absorbent fibers comprise starch grafted copolymers, cross-linked carboxymethylcellulose, modified hydrophilic polyacrylate, or combinations thereof.

6. The fabric of claim 1 wherein the membrane has a porosity rating of between about 5 and about 220 microns.

7. The fabric of claim 1 wherein the membrane is sealed about the core by ultrasonics, heat, infra-red, sewing thread, or adhesive.

8. The fabric of claim 1 wherein the membrane comprises cotton, rayon, flax, jute, knaf, ramie, polyester, polyolefin, polyamide, acrylic, polyethylene, PLA, PTT, or combinations thereof.

9. The fabric of claim 1 wherein the core and membrane of the composite yarn comprise 100% biodegradable materials.

* * * * *